United States Patent [19]

Longstaff

[11] 4,044,747

[45] Aug. 30, 1977

[54] SPARK IGNITION ENGINE

[75] Inventor: Kenneth Longstaff, Alcester, England

[73] Assignee: British Leyland UK Limited, London, England

[21] Appl. No.: 652,043

[22] Filed: Jan. 26, 1976

[30] Foreign Application Priority Data

Feb. 4, 1975 United Kingdom ..... 4641/75

[51] Int. Cl.[2] ..... F02P 3/02

[52] U.S. Cl. ..... 123/148 E; 123/148 ND; 200/19 M; 315/209 T

[58] Field of Search ..... 123/146.5 A, 148 E, 123/148 ND, 148 DK; 200/19 M; 315/209 T, 209 M

[56] References Cited

U.S. PATENT DOCUMENTS

| | | | |
|---|---|---|---|
| 2,781,412 | 2/1957 | Mike | 200/19 M |
| 3,250,955 | 5/1966 | Krikac | 315/209 M |
| 3,291,109 | 12/1966 | Neapolitakis | 200/19 M |
| 3,308,341 | 3/1967 | McLaughlin | 123/148 DK |
| 3,375,812 | 4/1968 | Kody | 200/19 M |
| 3,422,804 | 1/1969 | Mastrigt | 123/148 E |
| 3,426,740 | 2/1969 | Hufton et al. | 123/146.5 A |
| 3,433,208 | 3/1969 | Dogadko et al. | 315/209 T |
| 3,594,518 | 7/1971 | Bates | 200/19 M |
| 3,678,224 | 7/1972 | Takeda | 209/19 M |
| 3,951,144 | 4/1976 | Siegle | 123/148 E |

*Primary Examiner*—Samuel W. Engle
*Assistant Examiner*—S. A. Cangialosi
*Attorney, Agent, or Firm*—Brisebois & Kruger

[57] ABSTRACT

A spark ignition engine has a crankshaft speed pulse generator and a plurality of cylinders each cylinder containing a spark plug. Each plug is connectable to a high voltage ignition winding by way of a reed relay. The relays are divided into two groups and, with a periodicity dependent on generator output, a selected relay in each group is closed immediately prior to generation of voltage in the winding and opened when the voltage has been dissipated. Although both plugs connected to the selected relays produce a spark only one of the cylinders contains fuel mixture and, consequently, one one power stroke occurs.

4 Claims, 1 Drawing Figure

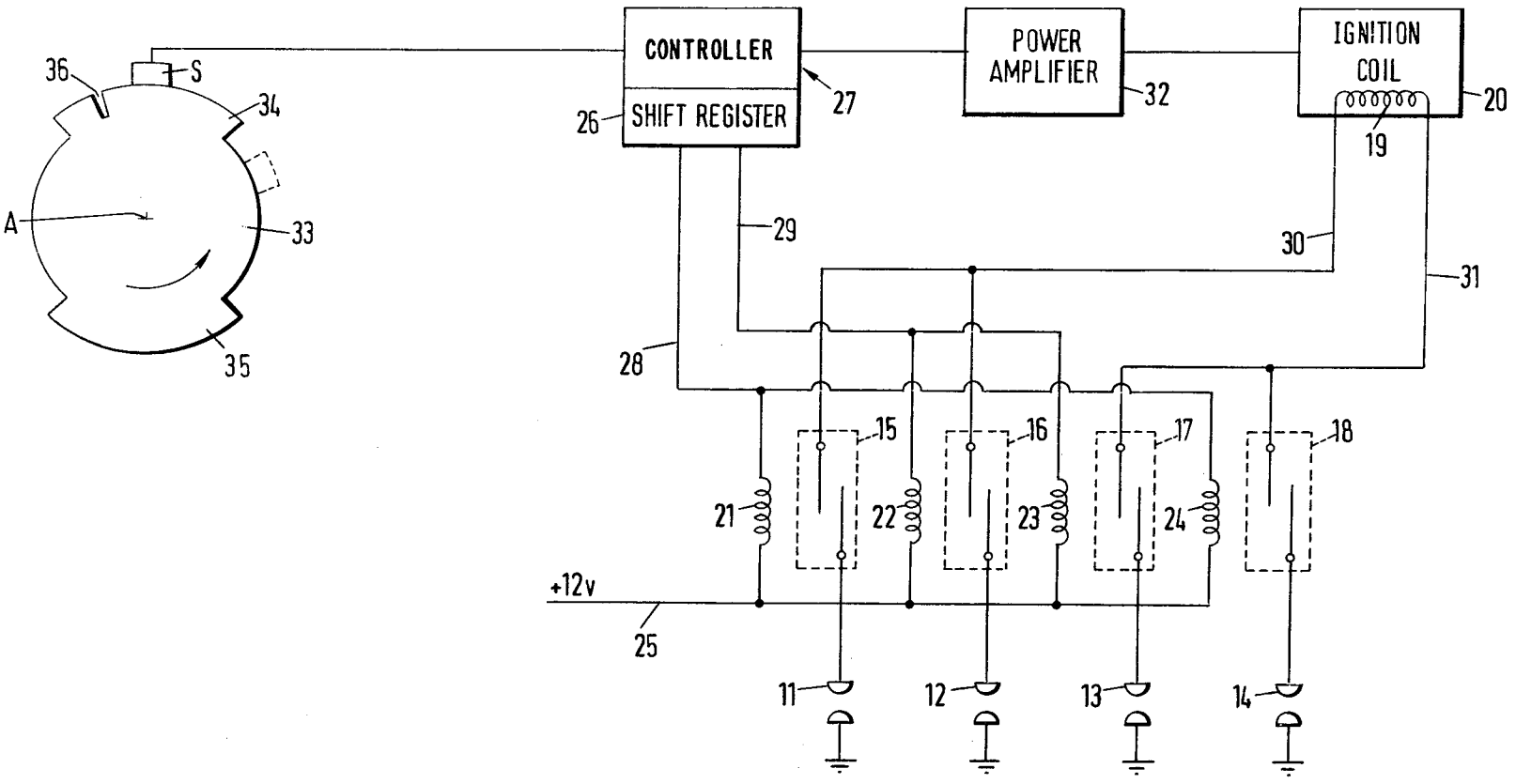
IGNITION COIL
POWER AMPLIFIER
CONTROLLER
SHIFT REGISTER
+12v
A
S
11
12
13
14
15
16
17
18
19
20
21
22
23
24
25
26
27
28
29
30
31
32
33
34
35
36

SPARK IGNITION ENGINE

This invention relates to a spark ignition engine. In particular is is concerned with an ignition system incorporated in such an engine.

According to the present invention there is provided a spark ignition engine, having a crankshaft to which is coupled a plurality of reciprocatable pistons, incorporating an ignition system comprising:

a. a crankshaft pulse generator adapted to generate output pulses in dependence on crankshaft speed;

b. an ignition coil having a high voltage secondary winding;

c. first and second groups of reed relays; each relay of the first group connecting one end of the secondary winding to a spark plug, each relay of the second group connecting the other end of the secondary winding to a spark plug; and d. a shift register adapted, in response to a pulse from the crankshaft pulse generator to close one reed relay in each group prior to generation of a voltage in the winding; the register also being adapted to cause the opening of the reed relay in each group when the voltage has been dissipated.

In a preferred form of the present invention the crankshaft pulse generator comprises a component incorporating a sensor adapted to provide an output on sensing the presence, or absence, of a juxtaposed blade of a plurality of blades rotatable by, or with, the crankshaft; one of the baldes being adapted so that when juxtaposed therewith the sensor provides an output distinctive of the blade.

An embodiment of the invention will now be described with reference to the accompanying drawings of which the sole figure is a circuit diagram of an ignition circuit for a four cylinder spark ignition engine.

Spark plugs 11–14 are coupled by way, respectively, of reed relays 15–18 to secondary winding 19 of an ignition coil 20. Each reed relay 15–18 can be closed, from its normally open position, by, respectively, solenoids 21–24. One end of each solenoid 21–24 is connected to a common 12-volt rail 25. The other end of solenoids 21, 24 are coupled to a shift register 26 by line 28. Likewise solenoids 22, 23 are coupled to shift register 26 by line 29. Shift register 26 is connected to controller 27 which receives pulses or signals from sensor S.

Relays 15, 16 have one end linked to one side of winding 19 by line 30. Relays 17, 18 have one end linked to the other side of winding 19 by line 31.

Pulses from controller 27 are fed to coil 20 after amplification in amplifier 32.

Pulses to regulate operation of controller 27 in dependence on crankshaft speed are generated by a component 33 adapted for rotation with the crankshaft about axis A in the direction of the arrow.

Sensor S serves to detect the presence, or absence of blades 34, 35 by photoelectric means. To enable the timing to be related to a datum crankshaft position a slot 36 is provided in blade 34 so that the output of sensor S when the blade 34 passes is distinguishable from that when the blade 35 passes. Controller 27 directs an input to shift register 26 during each transition of sensor S to or from a condition of a sensed blade to shift or switch the signal on the lines 28 and 29. Controller 27 also pulses power amplifier 32 in response to each such transition of sensor S to generate a high voltage in winding 19 subsequent to the closing of the appropriate relays.

In operation the component 33 rotates at crankshaft speed. On blade 34 arriving at sensor S a pulse is fed to the controller 27 which causes a signal to be fed to a line 28 to energize solenoids 21, 24 and so close reed relays 15, 18.

Simultaneously the controller 27 feeds a pulse to coil 20 by way of amplifier 32. A high voltage is consequently generated in winding 19 which passes along lines 30, 31 to all four relays 15 to 18. As only relays 15, 18 are closed only spark plugs 11 and 14 will cause an ignition spark. As only the cylinder in which plug 11 is disposed has an ignitible mixture in it then on ignition of the mixture that cylinder alone will provide a power output stroke.

On blade 34 leaving sensor S a further pulse is fed to the controller 27 causing, firstly, the removal of the signal on line 28, with the consequent opening of relays 15, 18 since solenoids 21, 24 are de-energized. Secondly a signal is fed to line 29 to energize solenoids 22, 23. Thereafter ignition coil 19 generates a high voltage pulse as before. However, as only relays 22, 23 are closed and only the cylinder in which plug 13 is disposed has an ignitible mixture in it then only one power stroke occurs.

In a similar manner the leading and trailing edges of blade 35 cause in turn, plugs 14 and 12 to spark ignitible fuel mixture in their respective cylinders.

I claim:

1. A spark ignition engine, having a crankshaft to which is coupled a plurality of reciprocatable pistons, incorporating an ignition system comprising:

a. a crankshaft pulse generator adapted to generate output pulses in dependence on crankshaft speed;

b. an ignition coil having a high voltage secondary winding;

c. a first group of at least two reed relays and a second group of at least two reed relays; each relay of the first group connecting one end of the secondary winding to a different spark plug, each relay of the second group connecting the other end of the secondary winding to a different spark plug; and d. a shift register adapted, in response to a pluse from the crankshaft pulse generator to close one reed relay in each group prior to generation of a voltage in the winding so that at least two spark plugs fire upon generation of a voltage in the winding; the register also being adapted to cause the opening of the reed relay in each group when the voltage has been dissipated.

2. A spark ignition engine as claimed in claim 1 wherein the crankshaft pulse generator comprises a component incorporating a sensor adapted to provide an output on sensing the presence, or absence, of a juxtaposed blade of a plurality of blades rotatable by the crankshaft; one of the blades being adapted so that when juxtaposed therewith the sensor provides an output distinctive of the one blade.

3. A spark ignition engine as claimed in claim 2 wherein the one of the blades being adapted by defining a slot so that when juxtaposed therewith the sensor provides the distinctive output to define a datum crankshaft position.

4. A spark ignition engine as claimed in claim 2 wherein the sensor comprises a photoelectric means.

* * * * *